US008998674B2

(12) United States Patent
Richins

(10) Patent No.: US 8,998,674 B2
(45) Date of Patent: Apr. 7, 2015

(54) TOY SWORD WITH REPLACEABLE HILT ASSEMBLY

(71) Applicant: Tyler Richins, Eager, AZ (US)

(72) Inventor: Tyler Richins, Eager, AZ (US)

( * ) Notice: Subject to any disclaimer, the term of this patent is extended or adjusted under 35 U.S.C. 154(b) by 0 days.

(21) Appl. No.: 14/277,956

(22) Filed: May 15, 2014

(65) Prior Publication Data

US 2014/0342634 A1 Nov. 20, 2014

Related U.S. Application Data

(60) Provisional application No. 61/823,613, filed on May 15, 2013.

(51) Int. Cl.
*A63H 33/30* (2006.01)
*A63H 33/00* (2006.01)

(52) U.S. Cl.
CPC ..... *A63H 33/009* (2013.01); *A63H 33/003* (2013.01)

(58) Field of Classification Search
USPC ..... 446/473, 478, 487; 434/11, 247; 463/47.2, 47.7; 482/12; D21/567, 568
See application file for complete search history.

(56) References Cited

U.S. PATENT DOCUMENTS

| | | | | | |
|---|---|---|---|---|---|
| 3,037,320 | A * | 6/1962 | Powell | 446/473 |
| 4,231,077 | A * | 10/1980 | Joyce et al. | 362/577 |
| 4,544,990 | A * | 10/1985 | Wieselman et al. | 362/551 |
| 4,612,001 | A * | 9/1986 | Burnham | 446/208 |
| 4,697,228 | A * | 9/1987 | Mui et al. | 362/352 |
| 4,717,365 | A * | 1/1988 | Andersen et al. | 446/230 |
| 4,892,303 | A * | 1/1990 | Lohre | 482/12 |
| 5,127,871 | A * | 7/1992 | Miller | 446/473 |
| 5,145,446 | A * | 9/1992 | Kuo | 446/405 |
| 5,389,033 | A * | 2/1995 | Rauch | 446/473 |
| 5,947,789 | A * | 9/1999 | Chan | 446/219 |
| 7,278,898 | B2 * | 10/2007 | Kim et al. | 446/473 |
| 7,611,398 | B2 * | 11/2009 | Woodhouse | 446/473 |
| 7,658,664 | B2 * | 2/2010 | Tong | 446/473 |
| D624,133 | S * | 9/2010 | Kelly et al. | D21/567 |
| 2007/0197128 | A1 * | 8/2007 | Reinhardt et al. | 446/473 |

* cited by examiner

*Primary Examiner* — Kurt Fernstrom
(74) *Attorney, Agent, or Firm* — Robert A. Parsons; Michael W. Goltry; Parsons & Goltry

(57) ABSTRACT

A toy sword including a blade having a tip and a base carried by a tubular member having a blade support end and a pommel end. The tubular member extends from the blade terminating in the pommel end. A front piece, a grip and a pommel each include a bore formed therethrough and are slidably received by the tubular member proximate the pommel end. A coupler removably couples the pommel to the tubular member proximate the pommel end, retaining the grip and the front piece in position on the tubular member between the pommel and the base of the blade.

12 Claims, 6 Drawing Sheets

TOY SWORD WITH REPLACEABLE HILT ASSEMBLY

FIELD OF THE INVENTION

This invention relates to toy swords.

More particularly, the present invention relates to toy swords with removable hilts.

BACKGROUND OF THE INVENTION

In the field of toy weapons and in particular those toy weapons which are contact type weapons such as swords, an emphasis must be placed on safety. The toy will undoubtedly be used against another individual, and that use must be safe and injury free. To this end, many toy swords are fabricated of foam or soft plastic. The ability to mold these toys opens up a wide range of shapes and designs. Essentially, these swords can be made to look like anything a designer desires. However, these weapons are also limited to a single design each. An individual, and particularly a child, likes to have some variety, and gains some enjoyment by having a new or different toy. Thus, multiple toys are purchased at full expense to satisfy the desire for diversity.

It would be highly advantageous, therefore, to remedy the foregoing and other deficiencies inherent in the prior art.

An object of the present invention is to provide a toy sword with a replaceable hilt assembly.

Another object of the present invention is to provide a modular toy sword.

Yet another object of the present invention is to provide a toy sword formed in multiple parts that can be interchanged and replaced as desired.

SUMMARY OF THE INVENTION

Briefly, to achieve the desired objects and advantages of the instant invention, provided is a toy sword including a blade having a tip and a base. Also provided is a blade element having a blade support end. The blade is carried by the blade element with the blade element extending from a position proximate the base of the blade to the blade support end at a point spaced from the tip of the blade. A tang element extends from the blade element in a direction opposite the blade support end proximate the base of the blade and terminates in a pommel end. A front piece is carried by the tang element adjacent the base. The front piece has a bore formed therethrough slidably received over the tang element. A grip is carried by the tang element adjacent the front piece. The grip has a bore formed therethrough slidably received over the tang element. A pommel is carried by the tang element adjacent the grip. The pommel has a bore formed therethrough slidably received over the tang element. A coupler removably couples the pommel to the blade element and retains the grip and the front piece in position on the tang element between the pommel and the base of the blade.

In another aspect of the invention, the tang element and the blade element are formed as a single tubular member and the coupler couples the pommel to the blade element by removably attaching the pommel to the pommel end of the tang element.

The coupler can be a button clip carried by the pommel end of the tang element. The button clip includes opposed buttons biased outwardly by a bias element carried therebetween. The buttons are received concurrently through opposed apertures formed in the pommel end of the tang element and opposed apertures formed in the pommel and aligned therewith in the locked position. The buttons are movable to an unlocked position by depressing the buttons against the bias of the biasing element and removing the buttons from the opposed apertures formed in the pommel.

In yet another aspect, the coupler can be a detent mechanism. The detent mechanism includes a detent formed on the surface of the pommel end of the tang element, a detent socket formed through the grip and positioned overlying the detent when the grip is in position on the tang element, and a lever. The lever has a handle end and terminates in an enlarged cylinder end having a curved surface with a flattened portion opposite the handle end. The lever is pivotally carried by the grip with the enlarged cylinder end rotatably carried within the detent socket and movable between a locked position wherein the curved surface is received in and engages the detent securing the grip and prevented relative movement with the tang element, and an unlocked position wherein the flattened portion overlies but does not engage the detent, allowing movement of the grip relative the tang member.

In a further aspect, a toy sword includes a blade having a tip and a base. A tubular member having a blade support end and a pommel end, carries the blade and extends from the base of the blade to the blade support end terminating at a point spaced from the tip of the blade. The tubular member also extends away from the blade in an opposing direction, from the base to the pommel end. A front piece is carried by the tubular member adjacent the base. The front piece has a bore formed therethrough slidably received over the tubular member. A grip is carried by the tubular member adjacent the front piece, the grip has a bore formed therethrough slidably received over the tubular member. A pommel is carried by the tubular member adjacent the grip. The pommel has a bore formed therethrough slidably received over the tubular member. A coupler removably couples the pommel to the tubular member proximate the pommel end, retaining the grip and the front piece in position on the tubular member between the pommel and the base of the blade.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
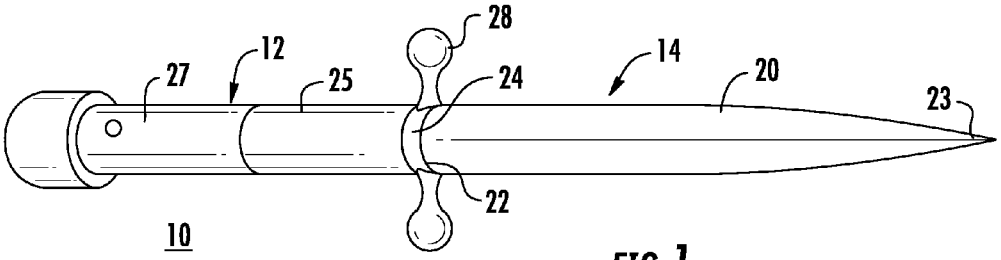
FIG. 1 is a perspective side view of a toy sword according to the present invention.
Figure 2:
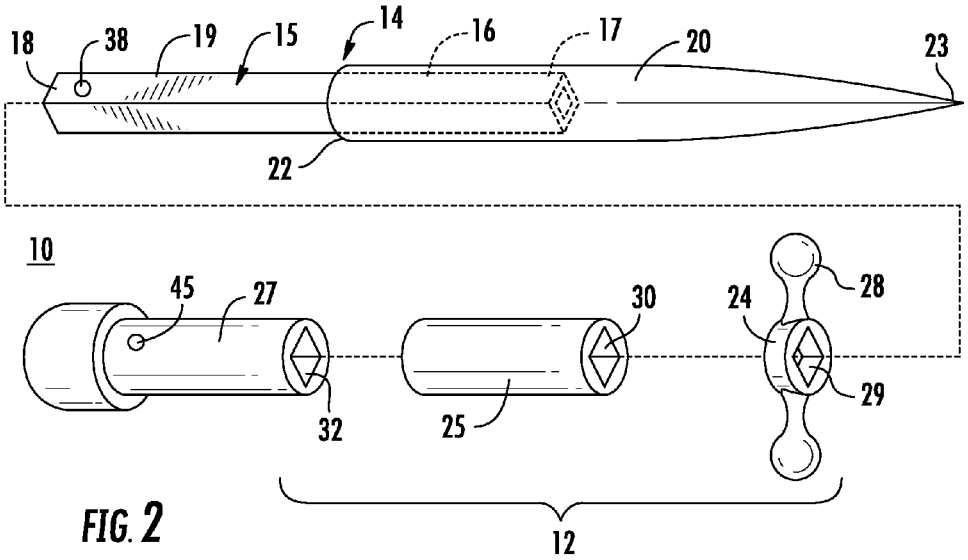
FIG. 2 is an exploded view of the toy sword of FIG. 1.

Turning now to the drawings in which like reference characters indicate corresponding elements throughout the several views, attention is directed to FIGS. 1 and 2 which illustrate a toy sword generally designated 10. Toy sword 10 is formed of multiple elements in a modular manner. Thus, each of the elements that will be described can be formed with a different visual design and can be readily exchanged to pride a different look. These elements can be exchanged individually or in groups as desired, to provide endless different possible designs and combinations. Toy sword 10 includes a hilt assembly 12 and a blade assembly 14. Blade assembly 14 includes a tubular member 15 having a blade support end 17 and a pommel end 18. While tubular member 15 is a single unitary piece in the present embodiment, it can be divided into a blade element 16 and a tang element 19 both physically, as will be described presently, and for purposes of description as for the present embodiment. A blade 20 is formed around and supported by blade element 16 of tubular member 15. Blade 20 can be formed of rubber, soft plastic and the like, but is preferably fabricated of foam, such as polyethylene foam, polyurethane and the like, either molded about blade element 16 or adhered thereto. The foam used is preferably a closed cell foam to prevent absorption of moisture, but a closed cell foam is not required. Blade 20 is flexible foam with rigidity provided by the centrally located tubular member 15. Tubular member 15 extends from a base 22 of blade 20 to a point spaced from a tip 23 of blade 20. The distance blade support end 17 terminates from tip 23 can vary, and is dependent on the flexibility or rigidity desired for blade 20 proximate tip 23. Tang element 19 of tubular member 15 extends outwardly from base 22 and terminating at pommel end 18 for receipt of hilt assembly 12.

Hilt assembly 12 can be formed of multiple elements but primarily consists of a front piece 24, a grip 25 and a pommel 27. Front piece 24 may or may not have a cross-guard 28 as desired. Front piece 24 is a one piece tubular element having a bore 29 through which is received pommel end 18. Front piece 24 is attached to blade assembly 14 by sliding it over pommel end 18 to reside against base 22 of blade 20. The cross sectional shape of pommel end 18 matches the cross-section of bore 29 of front piece 24. Additionally, tubular member 15 has a non-circular cross-sectional shape, such as square, triangular, oval and the like, to prevent relative rotation between hilt assembly 12 and at least tang element 19 of tubular member 15. Thus, pommel end 18 is received through front piece 24 much as a socket in a socket wrench. This prevents any twisting or turning of hilt assembly 12 when attached.

Still referring to FIGS. 1 and 2, grip 25 includes a bore 30 through which is received pommel end 18. Grip 25 is attached to blade assembly 14 by sliding it over pommel end 18 to reside against front piece 24. Pommel 27 includes a bore 32 through which is received pommel end 18. Pommel 27 is attached to blade assembly 14 by sliding it over pommel end 18 to reside against grip 25. The entire hilt assembly is fixed to pommel end 18 by pommel 27 positioned on pommel end 18 behind grip 25 and attached by a button clip 35. It should be understood that while three pieces, are illustrated in this embodiment, each piece can be divided into additional pieces, or conversely, less than three pieces can be employed by combining any or all of the three pieces. In this manner, hilt assembly 12 can be changed on the sword at will and the elements can be mixed and matched to achieve a desired structure.

Figure 3:
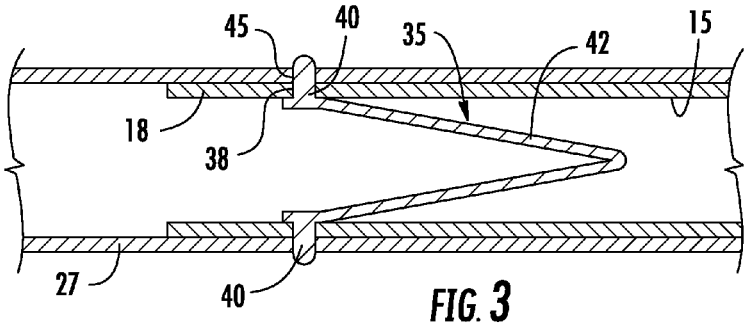
FIG. 3 is an enlarged sectional view of the attachment mechanism of the hilt assembly.

With additional reference to FIG. 3, a coupler is carried by pommel end 18 for engagement with hilt assembly 12. In this preferred embodiment, the coupler is button clip 35. In the preferred embodiment, pommel end 18 of tubular member 15 is formed with opposed apertures 38 configured to receive therethrough depressible buttons carried by spring member 42. Each element of hilt assembly 12 except pommel 27 is carried on tubular member 15 between apertures 38 and base 22, with pommel 27 having corresponding apertures 45 overlying and aligned with apertures 38 when correctly positioned on pommel end 18. In this manner, buttons 40 extending through apertures 38 enter apertures 45, retaining pommel 27 on pommel end 18, and in turn retaining the entirety of hilt assembly 12. Hilt assembly 12 is easily and quickly removed by depressing buttons 40, removing them from apertures 45, and removing pommel 27.

Figure 4:
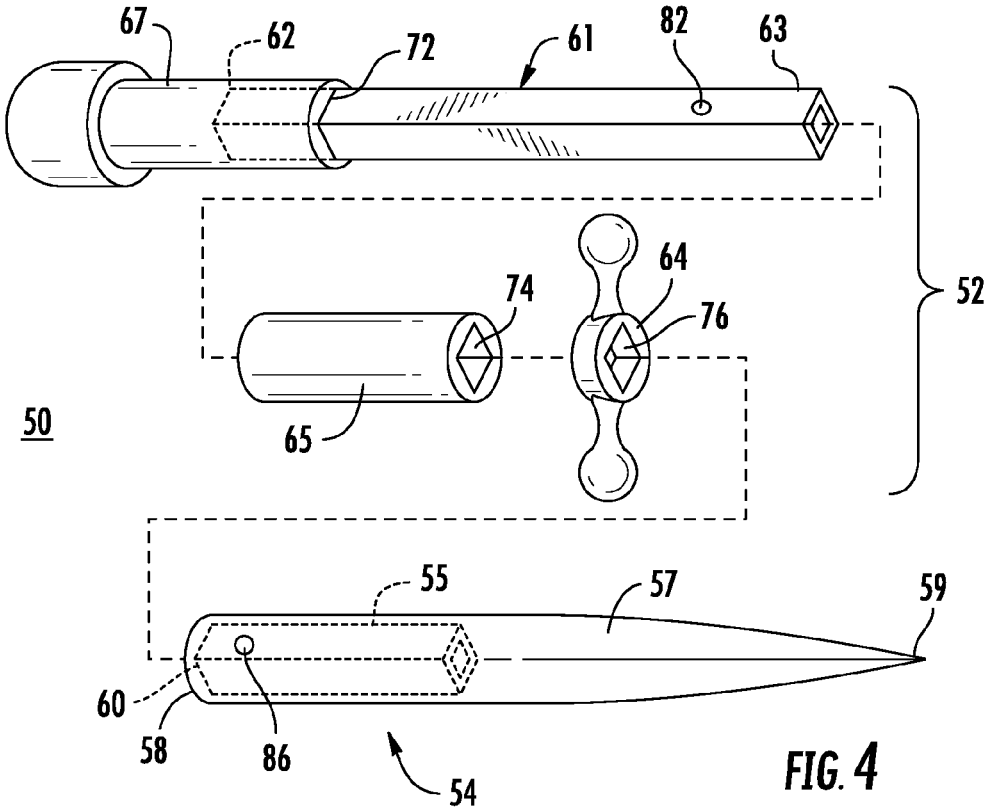
FIG. 4 is an exploded view of another embodiment of a toy sword according to the present invention.

Turning now to FIG. 4, another preferred embodiment of a sword generally designated 50 is illustrated. Sword 50 includes a hilt assembly 52 and a blade assembly 54. Blade assembly 54 includes a tubular member 55 supporting a blade 57. Blade 57 is formed around and supported by tubular member 55. Blade 57 is preferably fabricated of foam, such as polyethylene foam and the like, either molded about tubular member 55 or adhered thereto. The foam used is preferably a closed cell foam to prevent absorption of moisture, but a closed cell is not required. Blade 57 is flexible foam with rigidity provided by the centrally located tubular member 55. Tubular member 55 extends from a base 58 of blade 57 to a point spaced from a tip 59 of blade 57. The distance tubular member 55 terminates from tip 59 can vary, and is dependent on the flexibility or rigidity desired for blade 57 proximate tip 59. A bore 60 extends along tubular member 55 from base 58 for receipt of a tang element 61. Tang element 61 is a tubular member having a pommel end 62 and a blade end 63. Additionally, tang element 61 has a non-circular shape, such as square, triangular, oval and the like, to prevent relative rotation between various hilt elements and tang element 61. Blade end 63 of tang element 61 is shaped to be received within bore 60 of tubular member 55.

Hilt assembly 52 can be formed of multiple elements, but primarily consists of a front piece 64, a grip 65 and a pommel 67. Pommel 67 includes a bore 72 in which is received pommel end 62 of tang element 61. Tang element 61 can be adhered to pommel 67, or formed as an integral piece. Grip 65 includes a bore 74 through which is received blade end 63 of tang element 61. Grip 65 is attached by sliding it over blade end 63 to reside against pommel 67. Front piece 64 is a one piece tubular element having a bore 76 through which is received blade end 63 of tang element 61. Front piece 64 is attached by sliding it over blade end 63 to reside against grip 65. Blade end 63 is then inserted into bore 60 of tubular member 55 and secured by a coupler with front piece 64 abutting base 58.

Figure 5:
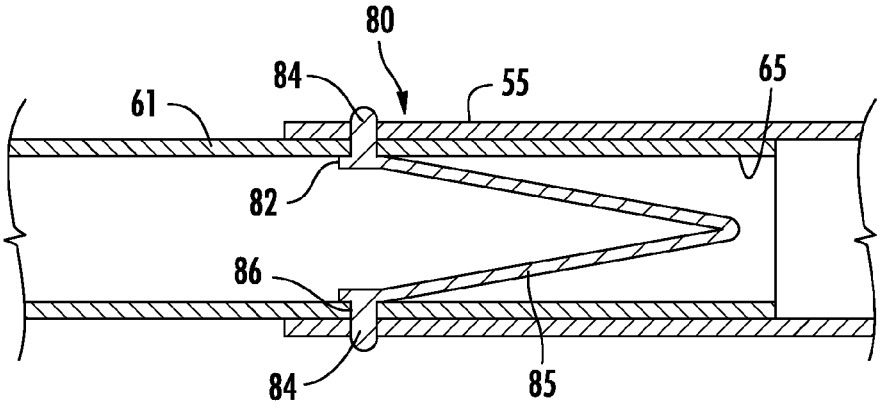
FIG. 5 is an enlarged sectional view of the attachment 8 mechanism of the hilt assembly of the toy sword illustrated in FIG. 4.

With additional reference to FIG. 5, a coupler is carried by tang element 61 for engagement with tubular member 55. In this preferred embodiment, the coupler is a button clip 80. In the preferred embodiment, blade end 63 of tang element 61 is formed with opposed apertures 82 configured to receive therethrough depressible buttons 84 carried by spring member 85. Each element of hilt assembly 12 is carried on tang element 61 between pommel 67 and apertures 82. Blade end 63 is inserted into bore 60 until apertures 82 align with corresponding apertures 86 formed in tubular member 55. In this manner, buttons 84 extending through apertures 82 enter apertures 86, retaining tang element 61, and in turn retaining the entirety of hilt assembly 52. Hilt assembly 52 is easily and quickly removed by depressing buttons 84, removing them from apertures 86, and removing tang element 61 from blade assembly 54.

It should be understood that the position of the various apertures for coupling the hilt assembly and the blade assembly are positioned for optimal arrangement of parts. It is also intended that multiple apertures can be provided to allow greater or lesser insertion of the tang end or tang element. This permits a longer or shorter hilt to be installed using more or less hilt pieces as desired.

Figure 6:
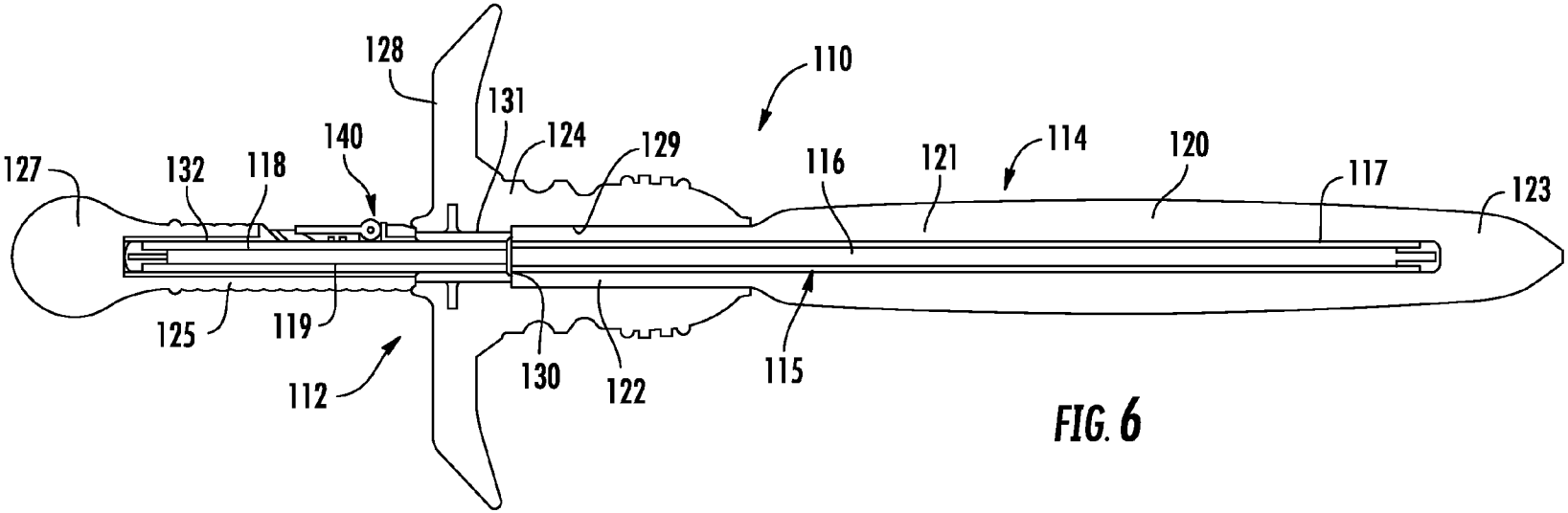
FIG. 6 is a sectional side view of a toy sword according to the present invention.

Turning now to FIG. 6, a toy sword generally designated 110 is illustrated. Toy sword 110 includes a hilt assembly 112 and a blade assembly 114. Blade assembly 114 includes a tubular member 115 having a blade support end 117 and a pommel end 118. While tubular member 115 is a single unitary piece in the present embodiment, it can be divided into a blade element 116 and a tang element 119 both physically, as was described previously, and for purposes of description as for the present embodiment. A blade 120 is formed with a central cavity 121 to receive blade element 116 of tubular member 115. Blade 120 is preferably fabricated of foam, such as polyethylene foam and the like, supported by blade element 116 of tubular member 115 carried within cavity 121. The foam used is preferably a closed cell foam to prevent absorption of moisture, but a closed cell is not required. Blade 120 is flexible foam with rigidity provided by the centrally located tubular member 115. Blade element 116 of tubular member 115 extends from a base 122 of blade 120 to a point spaced from a tip 123 of blade 120. The distance blade support end 117 terminates from tip 123 can vary, and is dependent on the flexibility or rigidity desired for blade 120 proximate tip 123. Tang element 119 of tubular member 115 extends outwardly from base 122 and terminates in pommel end 118 for receipt of hilt assembly 112.

Hilt assembly 112 can be formed of multiple elements, but primarily consists of a front piece 124, a grip 125 and a pommel 127. Front piece 124 may or may not have a crossguard 128 as desired. Front piece 124 is a one piece tubular element having a bore 129 through which is received pommel end 118. Front piece 124 is attached to blade assembly 114 by sliding it over pommel end 118 to reside over base 122 of blade 120. In this embodiment, bore 129 includes two diameters, forming a forwardly directed shoulder 130 against which base 122 of blade 120 abuts. The smaller diameter of bore 129 is lined with a bushing 131 of rigid plastic to strengthen the engagement between front piece 124 and tubular member 115.

Still referring to FIG. 6, grip 125 includes a bore 132 through which is received pommel end 118. Grip 125 is attached to blade assembly 114 by sliding it over pommel end 118 to reside against front piece 124. Grip 125 terminates in pommel 127, integrally formed therewith in this embodiment. The entire hilt assembly 112 is fixed to tang end 118 by a coupler 140. It should be understood that while hilt assembly 112 includes two main pieces, each piece can be divided into additional pieces, or conversely, less than two pieces can be employed by combining the two preferred pieces. In this manner, hilt assembly 112 can be changed on the sword at will and the elements can be mixed and matched to achieve a desired structure and look.

Figure 7:
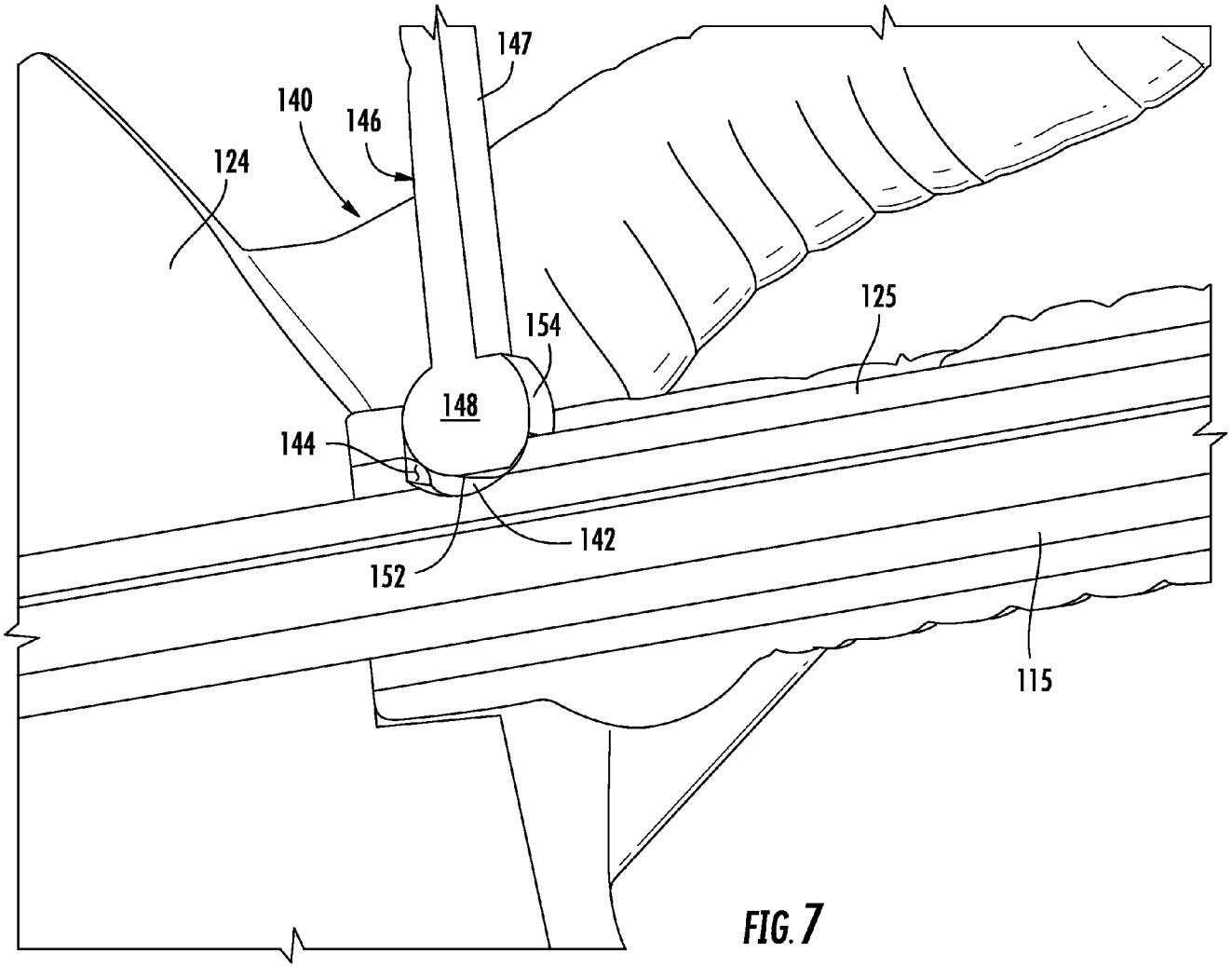
FIG. 7 is an enlarged partial sectional view of the coupler of the hilt assembly in an unlock position.
Figure 8:
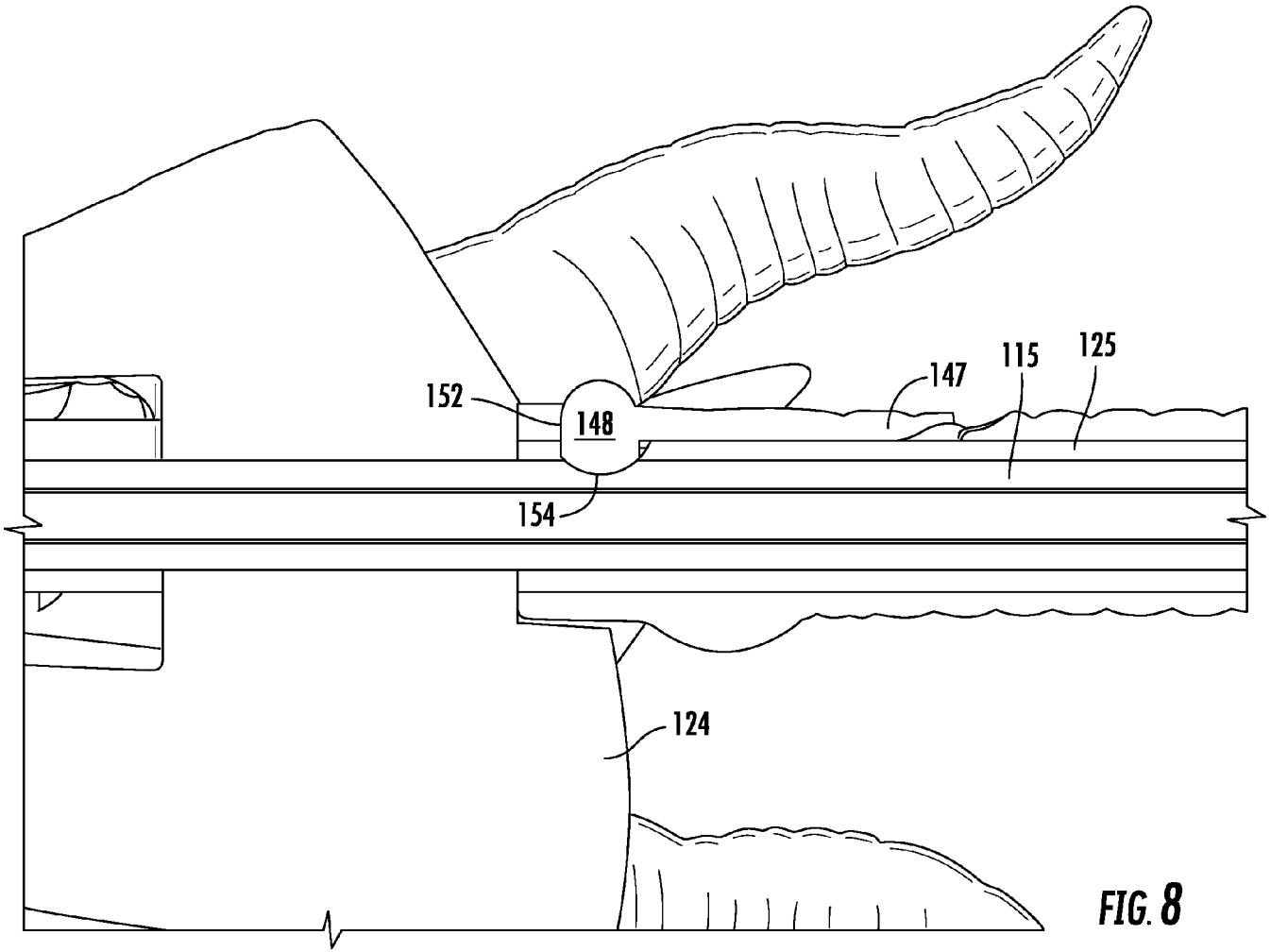
FIG. 8 is an enlarged partial sectional view of the coupler of the hilt assembly in a lock position.
Figure 9:
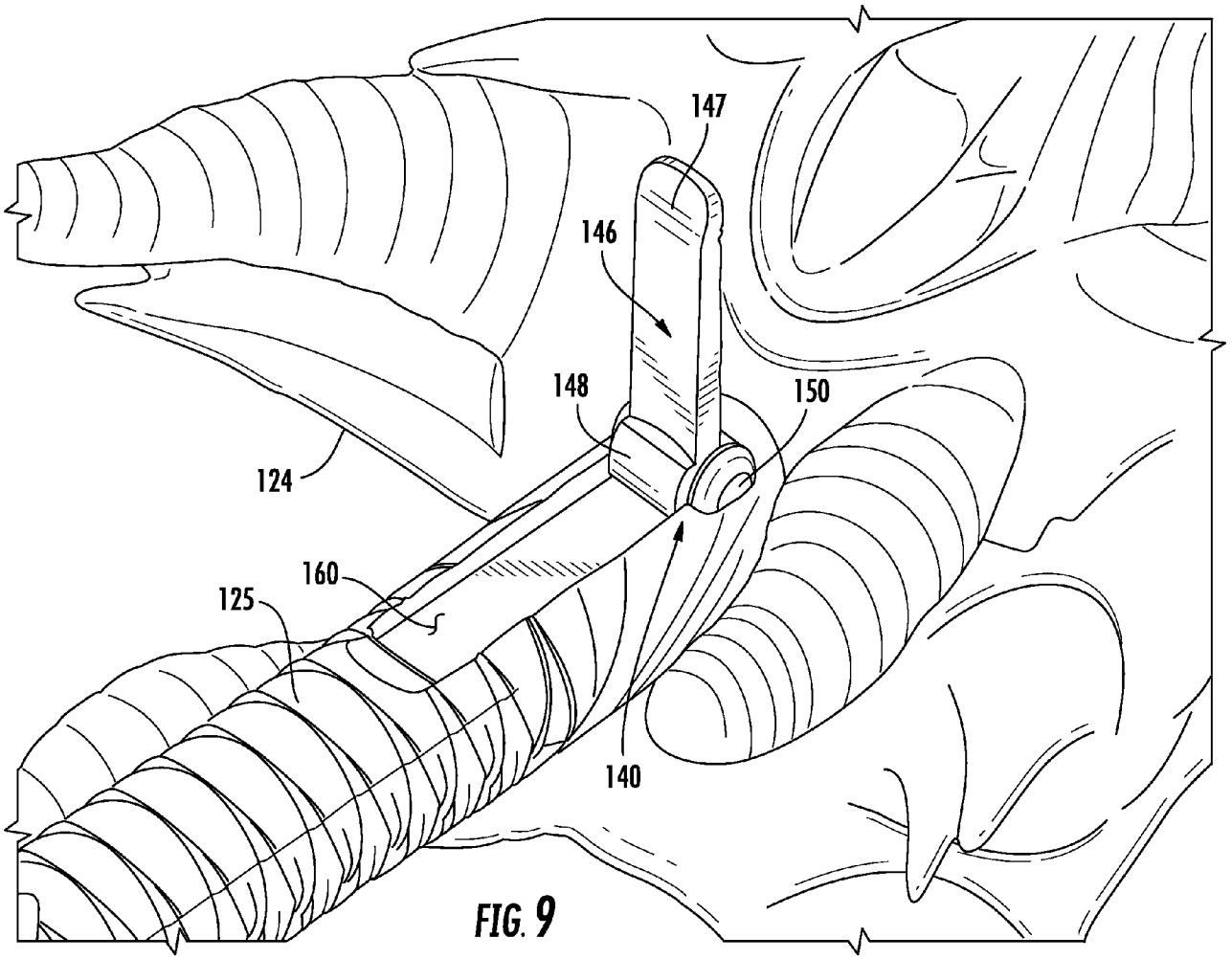
FIG. 9 is a partial perspective view of the coupler of the hilt assembly in the unlock position.

With additional reference to FIGS. 7, 8 and 9, a coupler 140 is carried by pommel end 118 for engagement with hilt assembly 112. In this preferred embodiment, coupler 140 is a detent mechanism. In the preferred embodiment, pommel end 118 of tubular member 115 is formed with a detent 142 on the surface thereof. A detent socket 144 is formed through grip 125 and positioned overlying detent 142 when grip 125 is engaging font piece 124. A lever 146 including a handle end 147 and terminating in an enlarged cylinder end 148, is pivotally carried by grip 125, with enlarged cylinder end 148 carried within detent socket 144. Enlarged cylinder end 148 of lever 146 is pivotally mounted within detent socket 144 and movable between a locked position and an unlocked position on a pin 150 carried by grip 125. In the unlocked position (FIGS. 7 and 9), a flattened surface 152 of cylinder end 148, opposing handle end 147, overlies but does not engage detent 142 formed in tubular member 115. In this position, grip 125 is free to move relative tubular member 115. In the locked position (FIG. 8) a curved surface (button) 154 of cylinder end 148, is received in and engages detent 142 formed in tubular member 115. In this position, grip 125 is secured, and prevented from moving relative tubular member 115. A shallow groove 160 can be formed in grip 125 for receiving handle end 147 in the locked position to maintain a smooth grip 125. In this manner, curved surface 154 extends through detent socket 144 and enters detent 142, retaining grip 125 on pommel end 118, and in turn retaining the entirety of hilt assembly 112. Hilt assembly 112 is easily and quickly removed by moving lever 146 to the unlocked position, and removing grip 125.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A toy sword comprising:

a blade having a tip and a base;

a blade element having a blade support end, the blade carried by the blade element with the blade element extending from a position proximate the base of the blade to the blade support end at a point spaced from the tip of the blade;

a tang element extending from the blade element in a direction opposite the blade support end proximate the base of the blade, terminating in a pommel end;

a front piece carried by the tang element adjacent the base, the front piece having a bore formed therethrough slidably received over the tang element;

a grip carried by the tang element adjacent the front piece, the grip having a bore formed therethrough slidably received over the tang element;

a pommel carried by the tang element adjacent the grip, the pommel having a bore formed therethrough slidably received over the tang element; and a coupler removably coupling the pommel to the blade element and retaining the grip and the front piece in position on the tang element between the pommel and the base of the blade.

2. A toy sword as claimed in claim 1 wherein the tang element is non-circular in cross-section, and the bores through the front piece, the grip and the pommel match the non-circular shape of the cross section of the tang element for receipt thereon without allowing rotation therebetween.

3. A toy sword as claimed in claim 1 wherein the blade is fabricated of foam.

4. A toy sword as claimed in claim 2 wherein the tang element and the blade element are formed as a single tubular member and the coupler couples the pommel to the blade element by removably attaching the pommel to the pommel end of the tang element.

5. A toy sword as claimed in claim 4 wherein the coupler is a button clip carried by the pommel end of the tang element, the button clip including opposed buttons biased outwardly by a bias element carried therebetween, the buttons received concurrently through opposed apertures formed in the pommel end of the tang element and opposed apertures formed in the pommel and aligned therewith in the locked position, the buttons movable to an unlocked position by depressing the buttons against the bias of the biasing element and removing the buttons from the opposed apertures formed in the pommel.

6. A toy sword as claimed in claim 4 wherein the coupler is a detent mechanism including:

a detent formed on the surface of the pommel end of the tang element;

a detent socket formed through the grip and positioned overlying the detent when the grip is in position on the tang element; and a lever having a handle end and terminating in an enlarged cylinder end having a curved surface with a flattened portion opposite the handle end, the lever is pivotally carried by the grip with the enlarged cylinder end rotatably carried within the detent socket and movable between a locked position wherein the curved surface is received in and engages the detent securing the grip and prevented relative movement with the tang element, and an unlocked position wherein the flattened portion overlies but does not engage the detent, allowing movement of the grip relative the tang member.

7. A toy sword as claimed in claim 2 wherein the bore of the front piece further includes two different diameters forming a forwardly directed shoulder against which the base of the blade abuts.

8. A toy sword as claimed in claim 2 wherein the coupler is a button clip carried by the tang element, the button clip including opposed buttons biased outwardly by a bias element carried therebetween, the buttons received concurrently through opposed apertures formed in the tang element and opposed apertures formed in the blade element and aligned therewith in the locked position, the buttons movable to an unlocked position by depressing the buttons against the bias of the biasing element and removing the buttons from the opposed apertures formed in the blade element.

9. A toy sword comprising:

a blade having a tip and a base;

a tubular member having a blade support end and a pommel end, the tubular member carrying the blade and extending from the base of the blade to the blade support end terminating at a point spaced from the tip of the blade, and extending away from the blade in an opposing direction, from the base to the pommel end;

a front piece carried by the tubular member adjacent the base, the front piece having a bore formed therethrough slidably received over the tubular member;

a grip carried by the tubular member adjacent the front piece, the grip having a bore formed therethrough slidably received over the tubular member;

a pommel carried by the tubular member adjacent the grip, the pommel having a bore formed therethrough slidably received over the tubular member; and a coupler removably coupling the pommel to the tubular member proximate the pommel end, retaining the grip and the front piece in position on the tubular member between the pommel and the base of the blade.

10. A toy sword as claimed in claim 9 wherein the coupler is a button clip carried by the pommel end of the tubular member, the button clip including opposed buttons biased outwardly by a bias element carried therebetween, the buttons received concurrently through opposed apertures formed in the pommel end of the tubular member and opposed apertures formed in the pommel and aligned therewith in the locked position, the buttons movable to an unlocked position by depressing the buttons against the bias of the biasing element and removing the buttons from the opposed apertures formed in the pommel.

11. A toy sword as claimed in claim 9 wherein the coupler is a detent mechanism including:

a detent formed on the surface of the pommel end of the tubular member;

a detent socket formed through the grip and positioned overlying the detent when the grip is in position on the tubular member; and a lever having a handle end and terminating in an enlarged cylinder end having a curved surface with a flattened portion opposite the handle end, the lever is pivotally carried by the grip with the enlarged cylinder end rotatably carried within the detent socket and movable between a locked position wherein the curved surface is received in and engages the detent securing the grip and prevented relative movement with the tubular member, and an unlocked position wherein the flattened portion overlies but does not engage the detent, allowing movement of the grip relative the tubular member.

12. A toy sword as claimed in claim 9 wherein the bore of the front piece further includes two different diameters forming a forwardly directed shoulder against which the base of the blade abuts.

* * * * *